US009091002B2

(12) United States Patent
Malloy et al.

(10) Patent No.: US 9,091,002 B2
(45) Date of Patent: Jul. 28, 2015

(54) WRAPPABLE END FRAY RESISTANT PROTECTIVE TEXTILE SLEEVE AND METHOD OF CONSTRUCTION THEREOF

(71) Applicant: Federal-Mogul Powertrain, Inc., Southfield, MI (US)

(72) Inventors: Cassie M. Malloy, Blue Bell, PA (US); Jean Ferrand, Crepy an valois (FR); Danny E. Winters, Downingtown, PA (US); Tianqi Gao, Exton, PA (US)

(73) Assignee: Federal-Mogul Powertrain, Inc., Southfield, MI (US)

( * ) Notice: Subject to any disclaimer, the term of this patent is extended or adjusted under 35 U.S.C. 154(b) by 0 days.

(21) Appl. No.: 13/782,813

(22) Filed: Mar. 1, 2013

(65) Prior Publication Data

US 2013/0228248 A1 Sep. 5, 2013

Related U.S. Application Data

(60) Provisional application No. 61/605,280, filed on Mar. 1, 2012.

(51) Int. Cl.
*D03D 3/02* (2006.01)
*D03D 1/00* (2006.01)
(Continued)

(52) U.S. Cl.
CPC ..... *D03D 3/02* (2013.01); *D03D 1/0035* (2013.01); *D03D 3/005* (2013.01); *D03D 13/008* (2013.01); *D03D 15/0077* (2013.01); *D03D 23/00* (2013.01); *D10B 2403/0311* (2013.01)

(58) Field of Classification Search
CPC ..... H02G 3/04; D03D 3/02; D03D 15/00; D03D 15/04; D03D 1/0041; D03D 11/00; D03D 11/02; D03D 15/0077; D03D 1/0035; D03D 23/00; D03D 3/00; F16L 57/00; F16L 59/021; H01B 3/50
See application file for complete search history.

(56) References Cited

U.S. PATENT DOCUMENTS 6,003,565 A 12/1999 Whittier, II et al.
6,309,721 B1 * 10/2001 Gladfelter et al. ..... 428/36.1
(Continued)

FOREIGN PATENT DOCUMENTS

WO 2007103779 A2 9/2007
WO 2008128022 A1 10/2008

OTHER PUBLICATIONS

"http://www.appropedia.org/index.php?title=Polymer_calendering&oldid=254799" Categories: MECH370 Materials processing; Chanda, Manas and Roy, Salil. Plastics Technology Handbook. Taylor and Francis Group, LLC. 2006.*
(Continued)

*Primary Examiner* — Bobby Muromoto, Jr.
(74) *Attorney, Agent, or Firm* — Robert L. Stearns; Dickinson Wright, PLLC

(57) ABSTRACT

A wrappable textile sleeve and method of construction includes an elongate wall having warp yarns extending generally parallel to a longitudinal central axis of the sleeve and fill yarns extending circumferentially about the sleeve. The warp yarns and the fill yarns are woven in an overlying and underlying weave pattern with one another. The warp yarns are arranged in discrete groups alternating about a circumference of the wall with adjacent groups having a different number of the warp yarns. As such, the wall is provided with groups of increased numbers of warp yarns that provide the sleeve with enhanced rigidity and abrasion resistance, while also being provided with groups of decreased numbers of warp yarns that provide the sleeve with enhanced flexibility along the longitudinal central axis.

20 Claims, 2 Drawing Sheets

(51) Int. Cl.

| | |
|---|---|
| ***D03D 3/00*** | (2006.01) |
| ***D03D 13/00*** | (2006.01) |
| ***D03D 15/00*** | (2006.01) |
| *D03D 23/00* | (2006.01) |

(56) References Cited

U.S. PATENT DOCUMENTS

| | | | | |
|---|---|---|---|---|
| 6,506,697 | B1 | 1/2003 | Samel | |
| 6,639,148 | B2 * | 10/2003 | Marks | 174/36 |
| 6,978,643 | B2 * | 12/2005 | Akers et al. | 66/170 |
| 7,300,692 | B2 | 11/2007 | Hirota et al. | |
| 7,523,532 | B2 * | 4/2009 | Yamaguchi et al. | 28/110 |
| 7,600,539 | B2 * | 10/2009 | Malloy et al. | 139/387 R |
| 7,754,301 | B2 * | 7/2010 | Yamaguchi et al. | 428/34.9 |
| 7,858,164 | B2 | 12/2010 | Tonooka et al. | |
| 8,273,429 | B2 * | 9/2012 | Sellis et al. | 428/36.1 |
| 2002/0013110 | A1 | 1/2002 | Samel | |
| 2003/0059562 | A1 * | 3/2003 | Lien et al. | 428/36.9 |
| 2003/0168248 | A1 * | 9/2003 | Savoy et al. | 174/136 |
| 2004/0003630 | A1 * | 1/2004 | Akers et al. | 66/197 |
| 2004/0081411 | A1 * | 4/2004 | Gladfelter et al. | 385/100 |
| 2005/0136255 | A1 * | 6/2005 | Gladfelter et al. | 428/375 |
| 2005/0260909 | A1 | 11/2005 | Hirahara | |
| 2007/0166495 | A1 * | 7/2007 | Sellis et al. | 428/36.1 |
| 2007/0210490 | A1 * | 9/2007 | Malloy et al. | 264/425 |
| 2007/0219289 | A1 * | 9/2007 | Phipps et al. | 523/152 |
| 2009/0218002 | A1 | 9/2009 | Kashihara | |
| 2009/0226653 | A1 * | 9/2009 | Harris et al. | 428/36.1 |
| 2010/0084179 | A1 * | 4/2010 | Harris et al. | 174/350 |
| 2010/0089515 | A1 * | 4/2010 | Malloy et al. | 156/56 |
| 2010/0196638 | A1 | 8/2010 | Puype et al. | |
| 2011/0083879 | A1 | 4/2011 | Avula et al. | |
| 2011/0171867 | A1 | 7/2011 | Li et al. | |
| 2012/0037263 | A1 * | 2/2012 | Malloy | 139/387 R |
| 2013/0000471 | A1 * | 1/2013 | Malloy et al. | 87/9 |
| 2013/0040081 | A1 * | 2/2013 | Yoshimura et al. | 428/34.1 |
| 2013/0206275 | A1 * | 8/2013 | Itoh | 139/35 |
| 2013/0228248 | A1 * | 9/2013 | Malloy et al. | 139/35 |

OTHER PUBLICATIONS

International Search Report mailed Oct. 24, 2013 (PCT/US2013/028729).

* cited by examiner

FIG. 2A
| DENT # | 1 | 2 | 3 | 4 | 5 | 6 | ... |
|---|---|---|---|---|---|---|---|
| WARPS/DENT | y | x | y | x | y | x | ... |
FIG. 3
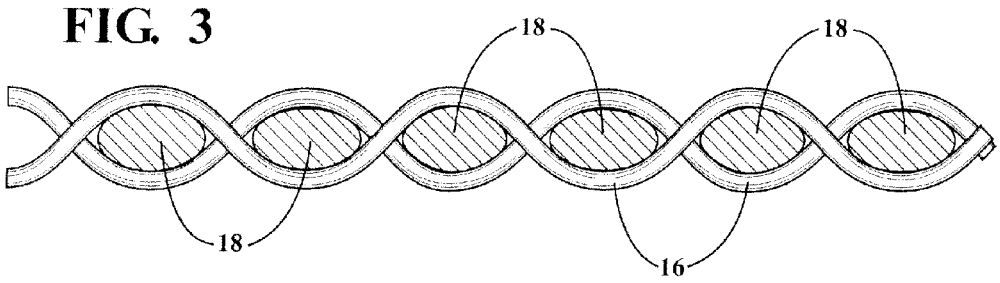
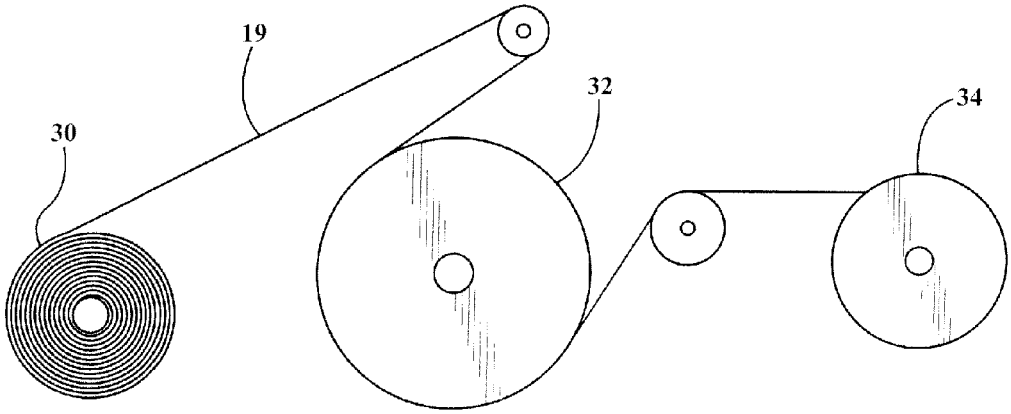
FIG. 4

WRAPPABLE END FRAY RESISTANT PROTECTIVE TEXTILE SLEEVE AND METHOD OF CONSTRUCTION THEREOF

CROSS-REFERENCE TO RELATED APPLICATION

This application claims the benefit of U.S. Provisional Application Ser. No. 61/605,280, filed Mar. 1, 2012, which is incorporated herein by reference in its entirety.

BACKGROUND OF THE INVENTION

1. Technical Field

This invention relates generally to protective sleeves for elongate members, and more particularly to woven textile sleeves.

2. Related Art

Elongate members, such as wires or wire harnesses, are commonly protected against abrasion and contamination by wrappable textile sleeves. It is known to construct wrappable textile sleeves from woven yarns. In order to form the desired sleeve length, and to avoid fraying the ends of the sleeve, it is known to use lasers, ultrasonic cutting devices, and the like, which melt the material of the sleeve wall during the cutting process, thereby reducing the likelihood of causing the material of the sleeve wall to fray. In addition, it is known to apply a chemical coating agent to the sleeve wall prior to cutting the sleeve wall to reduce the likelihood of fraying the material of the sleeve wall during the cutting process. Although the aforementioned mechanisms can be effective in reducing the likelihood of fraying the material of the sleeve wall, they require specialized cutting devices or processes, and thus, they come at an added cost.

SUMMARY OF THE INVENTION

A wrappable, end fray resistant textile sleeve for protecting elongate members is provided. The sleeve includes an elongate wall having warp yarns extending generally parallel to a longitudinal central axis of the sleeve and fill yarns extending circumferentially about the sleeve. The warp yarns and the fill yarns are woven in an overlying and underlying weave pattern with one another. The warp yarns are arranged in discrete groups alternating about a circumference of the wall with adjacent groups having a different number of the warp yarns. As such, the wall is provided with groups of increased numbers of warp yarns that provide the sleeve with enhanced rigidity and abrasion resistance, while also being provided with groups of decreased numbers of warp yarns that provide the sleeve with enhanced flexibility along the longitudinal central axis.

In accordance with another aspect of the invention, the overlying and underlying weave pattern is formed as one of a plain, rib, basket or twill weave pattern.

In accordance with another aspect of the invention, the overlying and underlying weave pattern is formed as a plain weave pattern. As such, static friction between each of the warp and weft yarns better retains their intended locations within the wall while being cut and during use.

In accordance with another aspect of the invention, each of the warp yarns in each of the discrete groups is woven in the plain weave pattern with the fill yarns, thereby further enhancing the warp and fill yarns being maintained in their intended locations while being cut and during use.

In accordance with another aspect of the invention, the different numbers of the warp yarns in the adjacent groups are X and Y, wherein X is greater than Y.

In accordance with another aspect of the invention, the warp yarns are monofilaments heat-set in a wavy, curly, sinusoidal configuration about the fill yarns. As such, the warp yarns act to grip and hold the fill yarns, thereby facilitating the warp and fill yarns being maintained in their intended locations while being cut and during use.

In accordance with another aspect of the invention, the fill yarns are multifilaments. As such, the wall is provided with enhance protection coverage and the full multifilaments act to grip the warp monofilaments, thereby preventing relative movement between the warp and fill yarns while being cut and during use.

In accordance with another aspect of the invention, the multifilaments have an air texturized finish.

In accordance with another aspect of the invention, the wall has opposite edges extending along the central longitudinal axis wherein the opposite edges are configured for overlapping relation with one another.

In accordance with another aspect of the invention, a method of constructing a wrappable, end fray resistant textile sleeve for protecting elongate members is provided. The method includes forming an elongate wall by weaving warp yarns and fill yarns with one another in an overlying and underlying weave pattern. The method further weaving the warp yarns in discrete groups alternating about a circumference of the wall with adjacent groups having a different number of said warp yarns.

In accordance with another aspect of the invention, the method further includes forming the overlying and underlying weave pattern as one of a plain, rib, basket or twill weave pattern.

In accordance with another aspect of the invention, the method further includes weaving each of the warp yarns in each of the discrete groups with the fill yarns in the plain weave pattern.

In accordance with another aspect of the invention, the method further includes arranging the different number of warp yarns in the adjacent groups having X and Y numbers of respective warp yarns, wherein X is greater than Y.

In accordance with another aspect of the invention, the method includes configuring X to equal 4 and configuring Y to equal 1.

In accordance with another aspect of the invention, the method includes providing the warp yarns as monofilaments and heat-setting the warp yarns to take on a sinusoidal shape.

In accordance with another aspect of the invention, the method includes heat-setting the warp yarns in a calendaring process after weaving the wall.

In accordance with another aspect of the invention, the method includes providing the fill yarns as multifilaments.

In accordance with another aspect of the invention, the method includes providing the fill yarns having an air texturized finish.

In accordance with another aspect of the invention, the method includes weaving the wall as a flat fabric.

BRIEF DESCRIPTION OF THE DRAWINGS

These and other aspects, features and advantages of the invention will become readily apparent when considered in connection with the following detailed description of presently preferred embodiments and best mode, appended claims and accompanying drawings, in which:

FIG. 2A is a chart detailing the number of yarns used per dent in weaving the wall of the sleeve of FIG. 1;

FIG. 3 is a side view showing warp yarns of the sleeve of FIG. 1 upon being heat-formed; and FIG. 4 is a schematic of a calendaring process used in constructing the wall of the sleeve of FIG. 1.

DETAILED DESCRIPTION OF PRESENTLY PREFERRED EMBODIMENTS

Figure 1:
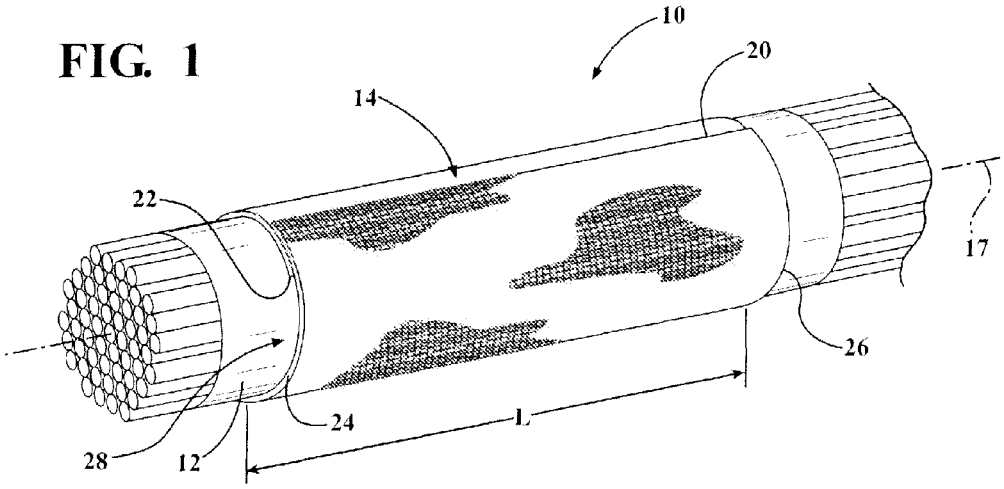
FIG. 1 is a schematic perspective view of a protective sleeve constructed in accordance with one presently preferred embodiment shown protecting an elongate member.

Referring in more detail to the drawings, FIG. 1 illustrates a wrappable, end fray resistant textile sleeve 10 constructed in accordance with one presently preferred embodiment of the invention. The sleeve 10 is particularly useful for protecting an elongate member 12 disposed therein, such as a wire harness, for example. The sleeve 10 has an elongate wall 14 having warp yarns 16 extending generally parallel to a longitudinal central axis 17 of the sleeve 10 and fill yarns 18 extending transversely to the warp yarns 16 and circumferentially about the wall 14. The warp yarns 16 and fill yarns 18 are woven with one another in an overlying and underlying weave pattern, such that they undulate over and under one another, such as in a plain, rib, basket or twill weave pattern, for example. In accordance with the invention, the warp yarns 16 are arranged in discrete groups A, B that alternate with one another about a circumference of the wall 14, wherein the groups A, B have a different number of the warp yarns 16 from one another, shown as group A having an increased number of warp yarns 16 in comparison to group B. Accordingly, the adjacent groups A, B have different warp yarn densities, although the groups A, B can span the same or substantially the same circumferentially extending width. The relatively increased density group A warp yarns 16 provide the sleeve 10 with an overall tightly woven structure. This is because a relatively high number of warp yarns 16 are contained within close, abutting or substantially abutting relation with one another. As a result of the relatively high density of warp yarns 16 in groups A, the end fray resistance of the wall 14 is enhanced when it is cut, such as in a cold-cutting process. Further, the relatively increased density groups A of warp yarns 16 provide the wall 14 with enhanced rigidity and abrasion resistance. These results provided by the increased density warp groups A result from the tightly interlocked warp yarns 16 within the groups A. Meanwhile, the relatively decreased density groups B of warp yarns 16 provide the sleeve 10 with enhanced flexibility. This enhanced flexibility is facilitated by gaps provided between the relatively low density groups B and the adjacent increased density groups A.

The sleeve wall 14 is initially woven as a flat sheet of material 19 that is further processed after weaving in a heating operation while flat, such as via a calendaring process (FIG. 4). Upon being heated and then cooled, the flat material 19 is then further processed in a cutting operation, such as via cold-cut operation, though a hot-cut or laser-cut operation can be used, for example, while flat to provide the desired length L of the finished sleeve 10, with each of the "as cut" ends forming opposite ends 24, 26 of the sleeve 10. The wall 14 is initially woven having a predetermined width extending between opposite parallel or substantially parallel edges 20, 22, wherein the edges 20, 22 extend generally parallel to the central longitudinal axis 17 between the opposite ends 24, 26. Upon being cut to length L, preferably via cold-cutting for low cost reasons, the opposite edges 20, 22 are configured to be wrapped about the axis 17 into overlapping relation with one another to form a circumferentially enclosed central cavity 28 for receipt of the elongate members 12.

Figure 2:
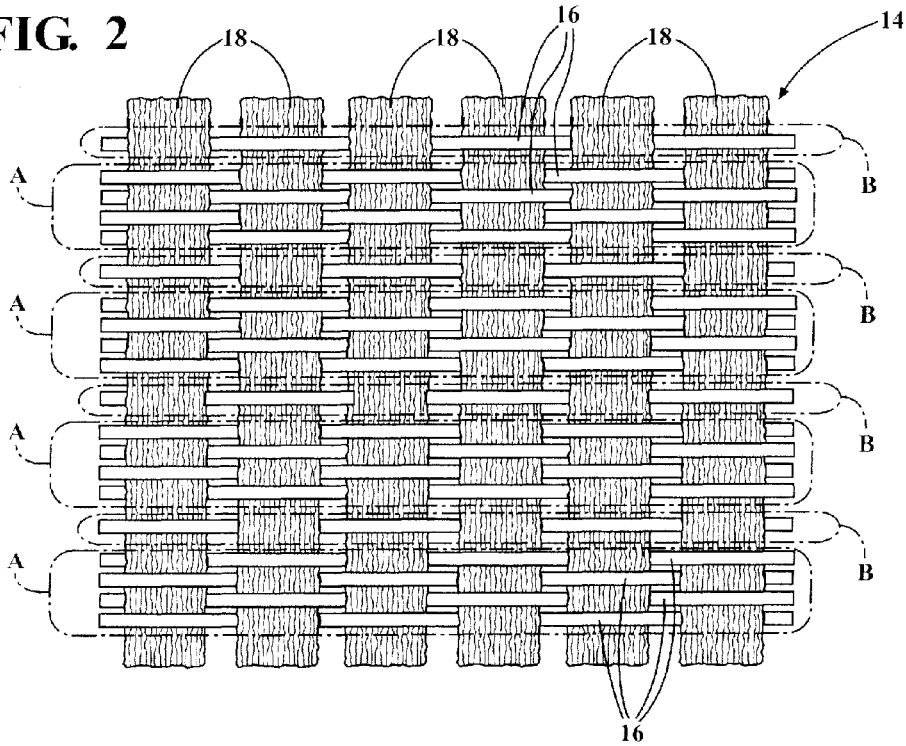
FIG. 2 is an enlarged partial plan view of the wall of the sleeve of FIG. 1.

The warp yarns 16 are provided mostly or entirely as monofilaments of a heat-formable material, such as poly(ethylene) terephthalate (PET) or poly(phenylene) sulfide (PPS), by way of example and without limitation, and the fill yarns 18 are provided mostly or entirely as relatively soft yet bulky multifilaments (such as having an air texturized finish, for example). The soft and bulky properties of the fill yarns 18 provide an increased amount friction against the warp yarns 16, thereby acting to stabilize and maintain the warp and fill yarns 16, 18 in their respective "as woven" locations. The warp yarns 16 are woven in their respectively varying tight and loose density groups A, B by varying the number of warp yarns 16 in adjacent dents (space between two wires in the loom through which the warp yarns 16 are drawn). For example, as shown in the resulting woven fabric of FIG. 2, one dent can receive a single warp yarn 16, thereby forming groups B, while an adjacent dent can receive four warp yarns 16, thereby forming groups A, with this pattern being repeated in alternating fashion across each of the dents of the loom. With the dents being of equal width, and the number of warp yarns being different within the adjacent dents, the density of warp yarns within adjacent dents is different, as discussed above with regard to the different groups A, B. Of course, this is just an example of the number of warp yarns 16 can be provided in the adjacent dents, wherein the number of warp yarns per dent can be other than 4 for groups A and 1 for groups B. What is important is that the number X of warp yarns 16 in groups A is greater than the number Y of warp yarns 16 in groups B, such that X is greater than Y (FIG. 2A).

Upon weaving the sheet of fabric, the fabric is heat processed while flat (heated and then cooled) to soften and shrink the warp yarns 16 lengthwise, thereby causing the warp yarns 16 to take on and retain a high level of crimp that takes a permanent set sinusoidal shape (FIG. 3). As such, the weave, such as a plain weave, of the resulting heat processed fabric is tightened, wherein the heat processed warp yarns 16 act to hold the weave structure tightly, which in turn facilitates preventing the fill yarns 18 from fraying (unraveling) during the cutting operation and while the sleeve 10 is in use. The same mechanism can prevent the warp yarns 16 from fraying (unraveling) during and after being cold cut along the axial length direction 17 of the fabric. The heating process can be performed in a calendaring process, wherein the woven flat fabric 19 is fed from a feed roll 30 about a surface of a heated roll 32, cooled and then stored on a take-up roll 34. Of course, the heating process can be a continuous, in-line process with the weaving process. Then, after heat forming the warp yarn 16 via the calendaring process, the fabric is cut to individual, desired length segments L, such as in a cold cut process, thereby not requiring specialized cutting devices, such as lasers, ultrasonic cutting devices, and the like, or processes, such as use of bonding agents or other chemicals, though they can be used if desired. Then, the "as cut" segments can be wrapped about the elongate members 12 to provide protection thereto. Of course, any suitable fastening mechanism can be used to retain the edges 20, 22 in their overlapped relation.

Obviously, many modifications and variations of the present invention are possible in light of the above teachings. It is, therefore, to be understood that within the scope of the appended claims and any ultimately allowed claims, the invention may be practiced other than as specifically described and shown.

What is claimed is:

1. A wrappable end fray resistant textile sleeve for protecting elongate members, comprising:

an elongate wall having warp yarns extending generally parallel to a longitudinal central axis of said sleeve and fill yarns extending circumferentially about said sleeve, said warp yarns and said fill yarns being woven in an overlying and underlying weave pattern with one another; and said warp yarns being arranged in discrete groups alternating about a circumference of said wall, each of said discrete groups being woven in a single dent, with adjacent groups occupying substantially the same circumferential width and having a different number of said warp yarns.

2. The wrappable end fray resistant textile sleeve of claim 1 wherein said overlying and underlying weave pattern is a plain weave pattern.

3. The wrappable end fray resistant textile sleeve of claim 2 wherein each of said warp yarns in each of said discrete groups is woven in said plain weave pattern with said fill yarns.

4. The wrappable end fray resistant textile sleeve of claim 1 wherein said different numbers of said warp yarns in said adjacent groups are X and Y, wherein X is greater than Y.

5. The wrappable end fray resistant textile sleeve of claim 3 wherein X equals 4 and Y equals 1.

6. The wrappable end fray resistant textile sleeve of claim 1 wherein said warp yarns are monofilaments heat-set in a sinusoidal configuration.

7. The wrappable end fray resistant textile sleeve of claim 6 wherein said fill yarns are multifilaments.

8. The wrappable end fray resistant textile sleeve of claim 7 wherein said multifilaments have an air texturized finish.

9. The wrappable end fray resistant textile sleeve of claim 6 wherein said wall has opposite edges extending along said central longitudinal axis, said opposite edges being configured in overlapping relation with one another.

10. A method of constructing a wrappable end fray resistant textile sleeve for protecting elongate members, comprising:

forming an elongate wall by weaving warp yarns and fill yarns with one another in an overlying and underlying weave pattern; and weaving said warp yarns in discrete groups alternating about a circumference of the wall with each of said discrete groups being woven in a single dent, with adjacent groups occupying substantially the same circumferential width and having a different number of said warp yarns.

11. The method of claim 10 further including forming the overlying and underlying weave pattern as a plain weave pattern.

12. The method of claim 11 further including weaving each of the warp yarns in each of the discrete groups with the fill yarns in the plain weave pattern.

13. The method of claim 10 further including arranging the different number of warp yarns in the adjacent groups having X and Y numbers of respective warp yarns, wherein X is greater than Y.

14. The method of claim 13 further including configuring X to equal 4 and configuring Y to equal 1.

15. The method of claim 10 further including providing the warp yarns as monofilaments and heat-setting the warp yarns to take on a sinusoidal shape.

16. The method of claim 15 further including heat-setting the warp yarns in a calendaring process.

17. The method of claim 15 further including providing the fill yarns as multifilaments.

18. The method of claim 17 further including providing the fill yarns having an air texturized finish.

19. The method of claim 10 further including weaving the wall as a flat fabric.

20. The wrappable end fray resistant textile sleeve of claim 1 wherein said adjacent groups having a different density of said warp yarns.

* * * * *